US006433477B1

(12) United States Patent
Ha et al.

(10) Patent No.: US 6,433,477 B1
(45) Date of Patent: Aug. 13, 2002

(54) PLASMA DISPLAY PANEL WITH VARIED THICKNESS DIELECTRIC FILM

(75) Inventors: Hong Ju Ha; Jae Sung Kim, both of Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/176,943

(22) Filed: Oct. 22, 1998

(30) Foreign Application Priority Data

Oct. 23, 1997 (KR) ..... 97-54382
Nov. 20, 1997 (KR) ..... 97-61373
Oct. 9, 1998 (KR) ..... 98-42168

(51) Int. Cl.[7] ..... H01J 17/49; H01J 1/62
(52) U.S. Cl. ..... 313/586; 313/584; 313/585
(58) Field of Search ..... 313/581, 582, 313/584, 585, 586, 483, 587

(56) References Cited

U.S. PATENT DOCUMENTS 5,548,186 A * 8/1996 Ota ..... 313/583
5,742,122 A * 4/1998 Amemiya et al. ..... 313/582
5,892,492 A * 4/1999 Osawa et al. ..... 345/60

FOREIGN PATENT DOCUMENTS

EP 0860849 A3 8/1998 ..... H01J/17/49
JP 8250029 9/1996 ..... H01J/17/49
JP 08-250029 9/1996 ..... J01J/11/00
JP 09-035642 2/1997 ..... H01J/11/02
JP 09-035644 2/1997 ..... H01J/11/02
JP 9035642 7/1997 ..... H01J/11/02
JP 10-092326 4/1998 ..... H01J/11/02
JP 9035644 7/1998 ..... H01J/11/02
JP 10-233171 9/1998 ..... H01J/11/02

* cited by examiner

*Primary Examiner*—Ashok Patel
*Assistant Examiner*—Karabi Guharay
(74) *Attorney, Agent, or Firm*—Fleshner & Kim, LLP

(57) ABSTRACT

PDP with a varied thickness dielectric layer, is disclosed, in which a surface discharge is caused by a minimum discharge initiation voltage, the PDP including a top panel having a plurality of pairs of display electrodes formed on a front substrate, and a dielectric layer on entire surfaces of the pairs of the display electrodes formed to have a varied thickness to be thin at an electric field concentration portion and thick at an electric field dispersion portion for restricting a discharge current, a bottom panel having a plurality of barriers formed on a rear substrate opposite to the display electrodes in the top panel at fixed intervals for prevention of cross talk between adjacent cells, address electrodes on each region between the barriers, and fluorescent material layer on side surfaces of the barriers and on the address electrodes, Frit glass for bonding the top panel and the bottom panel, and a mixture gas filled, and sealed in discharge spaces in cells.

45 Claims, 4 Drawing Sheets

PLASMA DISPLAY PANEL WITH VARIED THICKNESS DIELECTRIC FILM

BACKGROUND OF THE INVENTION

1. Field of the Invention

The present invention relates to a plasma display panel (hereafter called as PDP), and more particularly, to a PDP with a varied thickness dielectric film.

2. Discussion of the Related Art

In general, the PDP is the most suitable for a flat display panel because the PDP has a fast data display rate and a large sized panel is available with easy. The PDP is suggested to be an AC type PDP or DC type PDP both with two electrodes, of which, it is known that a surface discharge type AC PDP is the most appropriate for a color display. The PDP is in general one of luminous device which uses gaseous discharge within each discharge cell for displaying an image. Because the PDP is simple to fabricate, easy to fabricate a large sized screen, and fast in response, it is spot lighted as a direct view image display with a large screen, particularly as a display directed to an age of HDTV.

FIG. 1 illustrates an overall perspective view of a related art surface discharge type AC PDP.

Referring to FIG. 1, the related art surface discharge type AC PDP is provided with, at large, a front substrate 1 for displaying an image, a rear substrate 2 disposed spaced from, and parallel to the front substrate 1, a plurality of barriers 3 arranged on the rear substrate 2 opposite to the front substrate 1 at fixed intervals, and a plurality of discharge spaces formed when the front substrate 1 and the rear substrate 2 are bonded. In detail, the PDP is provided with address electrodes 4 each provided between every adjacent barriers 3, a fluorescent film 5 formed on both walls of each barrier 3 in each of the discharge spaces and on the address electrode 4 on a bottom surface of each of the discharge spaces for emitting a visible light at discharge of the cell, and a display electrode 6 and a bus electrode 7 formed alternatively on the front substrate 1 opposite to the rear substrate 2. The display electrode 6 and a bus electrode 7 are formed in a direction perpendicular to a direction of the plurality of address electrodes 4, to have a plurality of cell discharge in an entire screen. There are a dielectric layer 8 formed on the display electrode 6 and a bus electrode 7 for restricting a discharge current, a protection layer 9 formed on the dielectric layer 8 for protecting the display electrode 6, the bus electrode 7, and the dielectric layer 8, and discharge gas in each discharge space for inducing the Penning effect.

FIG. 2 illustrates a cross section of a plurality of discharge cells in a related art surface discharge type AC PDP, wherein one pair of transparent electrodes 13 on a front substrate 11 are shown turned by 90° for convenience of understanding. The display electrode 21 has a pair of a transparent electrode 13 and a metal electrode 22.

Referring to FIG. 2, the related art surface discharge type AC PDP is provided with a top panel having one pair of transparent electrodes 13 formed on a front panel 11, a first, and a second dielectric layers 14 and 15 on an entire surfaces of the pair the transparent electrodes 13 for restricting a discharge current, and a protection layer 16 formed on the second dielectric layer 15. And, there is a bottom panel having address electrode 17 formed on a region of a rear substrate 12 to cross the pair of transparent electrodes 13 in the top panel, barriers 19 for providing different colors between adjacent cells each with an address electrode 17, and a fluorescent material layer 18 formed on the barrier 19 and the address electrodes 17. There is Frit glass(not shown) bonding the front substrate 11 in the top panel and the rear substrate 12 in the bottom panel together and a mixture gas filled in discharge space 20 and sealed, completely.

In the aforementioned related art surface discharge type AC PDP, upon application of a discharge initiation voltage to one of the display electrodes 21 and an address signal to the address electrode 17 on the same time, a writing discharge is occurred in the discharge cell. That is, an electric field is established in the discharge cell, to accelerate a small amount of electrons present in the discharge gas to collide with neutral particles in the gas, causing ionization of the neutral particles into electrons and ions and another collisions of the ionized electrons with neutral particles, which again causes ionization of the neutral particles into electrons and ions at a faster rate, resulting to turn the discharge gas into a plasma state and cause a surface discharge 20*a* in the discharge space 20 from surfaces of the first, and second dielectric layers 14 and 15 and the protection layer 16, emitting a vacuum ultra-violet(uv) ray. This vacuum ray excites the fluorescent material layer 18, to cause the fluorescent material layer to emit a visible light, which is directed to outside of the panel through the front substrate 11, to display R, G, B color. That is, spatial charges present in the discharge space 20 are accelerated by a sustain voltage applied to each display electrode 21, and make collision with the inert gas filled in the discharge space 20 at 400~500 Torr, emitting the vacuum UV ray. The inert mixture gas has helium He as a major gas, and added with xenon Xe and neon Ne. The vacuum UV ray hits on the fluorescent material layer 18 on the address electrode 17 and the barrier 19, emitting a visible light. In other words, a color display is made by a combination of R, G, B, defined at least 3 luminescent regions.

It is required in the aforementioned PDP to reduce a discharge current for improving a luminous efficiency. This discharge current is substantially influenced by thicknesses of the first, and second dielectric layers 14 and 15 on the display electrode 21; if the first, and second dielectric layers 14 and 15 are thin, the discharge initiation voltage is in general low and the discharge current is increased, but if the first and second dielectric layers 14 and 15 are the more thicker, the discharge initiation voltage becomes the more lower and the discharge current becomes reduced the more. Therefore, if the dielectric layer is simply formed thicker, the discharge current may be reduced, but the discharge initiation voltage rises, making actual PDP driving difficult. Charges in the space after initiation of a discharge moves from ① to ② to cut off an external voltage and attached to surfaces of the first, and second dielectric layers 14 and 15 to drop a voltage in the discharge space. According to this, a waveform of the discharge current is formed in a form the discharge stops once the discharge is occurred. Since a tail portion of the discharge current serves nothing in the light emission but waste power, it is required to shorten the tail portion of the discharge current. The luminous efficiency can be defined by an equation (1), below.

$$\text{Luminous Efficiency } (\text{lm/W}) = \frac{\text{luminance } (\text{cd/m}^2) \times \text{area } (\text{m}^2) \times \pi}{\text{power consumption } (\text{W} = \text{voltage} \times \text{current})} \quad (1)$$

When the discharge initiated from a gap of the display electrodes in the surface type AC PDP propagates in a width direction step by step, the tail portion of the discharge current corresponds to an end portion in the width direction of the display electrode. In this instance, it is possible that the discharge current can be dropped without raising the discharge voltage by providing a dielectric layer having a thickness formed gradually thicker in the width direction of the display electrode.

The blind reduction of the dielectric layer thickness in the related art surface type AC PDP for lowering the discharge initiation voltage to cause a surface discharge in each cell results in an increased capacitance, that causes problems of an increased power consumption and a breakage of insulation.

The related art PDP, with a luminous efficiency below 1lm/W, has a very low conversion ratio of power consumption for causing a discharge to a light.

In the present invention, a thickness of the dielectric layer at a portion the discharge initiates is formed thin while a thickness of the dielectric layer in rest of the portion is formed gradually thicker so that the discharge voltage is dropped and the discharge efficiency is improved without no substantial increase of the power consumption. And, in the present invention, erroneous discharges due to cross talks between the display electrodes are reduced by enlarging the discharge spaces, and a contrast is improved by providing different paths of incident lights.

SUMMARY OF THE INVENTION

Accordingly, the present invention is directed to a PDP with a varied thickness dielectric film that substantially obviates one or more of the problems due to limitations and disadvantages of the related art.

An object of the present invention is to provide a PDP with a varied thickness dielectric films, for providing a larger discharge space and improving a contrast.

Another object of the present invention is to provide a PDP with a varied thickness dielectric films, which can form a curved surface naturally in coating the dielectric layer.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the plasma display panel includes a plurality of pairs of display electrodes formed on a front substrate, a dielectric layer with a varied thickness formed on entire surfaces of the pairs of the display electrodes, and a protection layer formed to a thickness on the dielectric layer.

In other aspect of the present invention, there is provided a plasma display panel including a plurality of pairs of display electrodes on a front substrate, a first dielectric layer formed on the pairs of the display electrodes to a thickness, a second dielectric layer formed to have a varied thickness in a tapered form on the first dielectric layer centered on a discharge space, the varied thickness being thin at an electric field concentration portion of the pair of display electrodes and thick at an electric field dispersion portion of the pair of display electrodes, and a protection layer formed in a tapered form on the first, and second dielectric layers to a thickness.

The object of present invention can be achieved by providing a PDP including a top panel having a dielectric layer on pairs of display electrodes on a front substrate formed to have varied thickness in a round form, tapered form, or stepped form, and a bottom panel having barriers formed on a rear substrate opposite to the display electrodes, address electrodes and fluorescent material layers formed in succession stacked in the barriers, and frit glass for vacuum bonding the top panel and the bottom panel together.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. FIGS. 4~7 illustrates surface discharge type PDP cell, wherein the pairs of transparent electrodes formed on a front substrate 101 are shown rotated by 90° for easy understanding.

Figure 4:
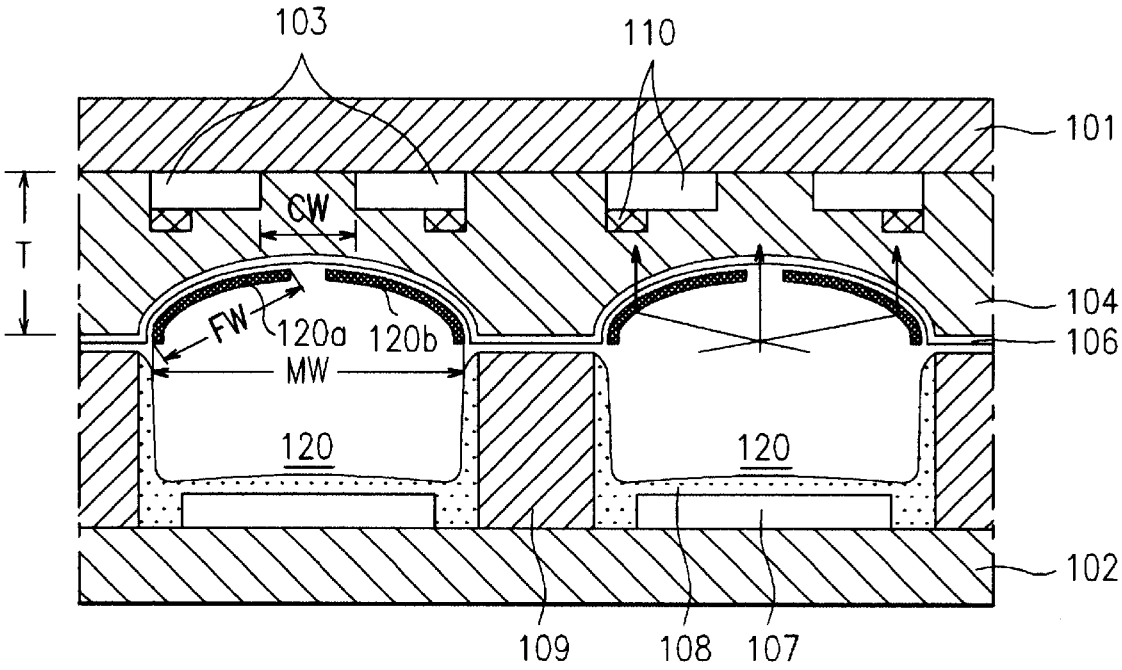
FIG. 4 illustrates a cross section of discharge cells in a PDP in accordance with a first preferred embodiment of the present invention.

Referring to FIG. 4, the PDP in accordance with a first preferred embodiment of the present invention includes a top panel having pairs of transparent electrodes 103 arranged in group units on a front substrate 101, a dielectric layer 104 formed on entire surfaces of the pair of transparent electrodes 103 for restricting a discharge current, and a protection layer 106 on an entire surface of the dielectric layer 104. The display electrode 110 has one pair of ITO electrodes 103 with a gap of 40 $\mu$m~150 $\mu$m therebetween and one pair of metal electrodes in contact with the ITO electrodes. The reference line CW indicates a width where the electric field is concentrated. Indium oxide $InO_2$ or tin oxide $SnO_2$ is deposited on the front substrate 101 by a thin film forming method, a dipping method, or screen printing method, to form the pair of transparent electrodes 103. And, the metal electrode is formed as a conductive thin firm to a desired dimension by photolithography or by printing metal paste added with black pigment at least two times. The dielectric layer 104 is formed by printing dielectric paste or deposition, with a thickness formed thin at an electric field concentrated portion and thick at an electric field dispersed portion. The dielectric layer 104 has a thickness T of 5 μm~200 μm, and the main discharge portion MW has a width of 30 μm~500 μm. FIG. 4 further shows discharge regions 120*a* and 120*b* within the plasma discharge space 120. Here, MW indicates a width of the main discharge portion 120, and FW indicates a width of the discharge region that is extended along with a width of the discharge sustain electrode.

Figure 5:
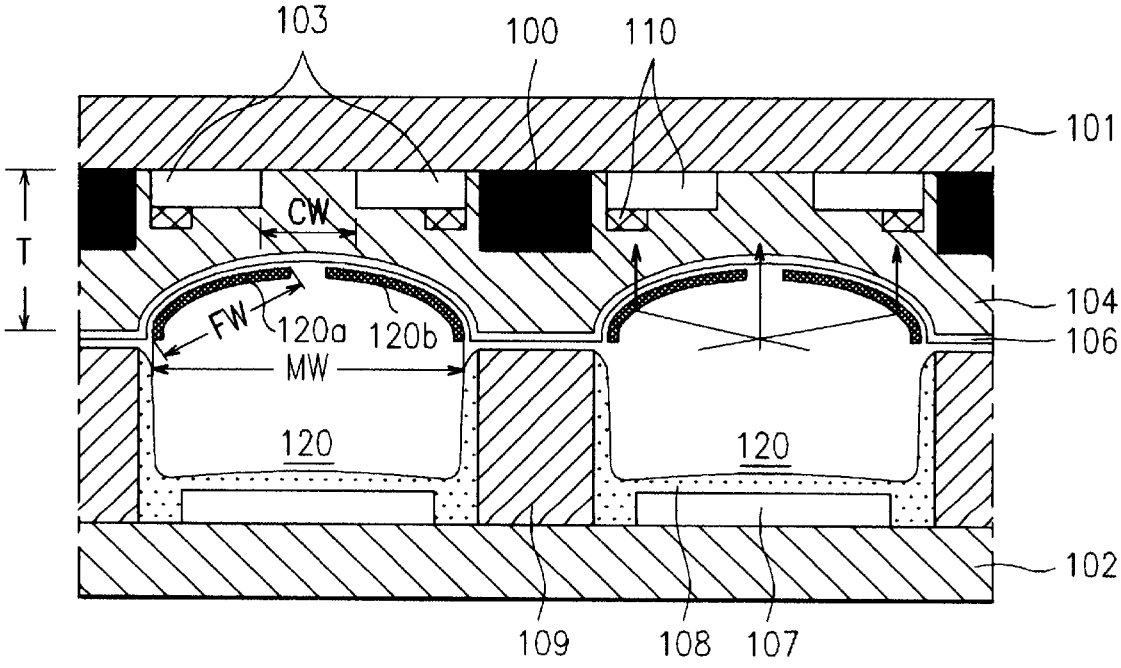
FIG. 5 illustrates a cross section of discharge cells in a PDP in accordance with a second preferred embodiment of the present invention.

Referring to FIG. 5, the PDP in accordance with a second preferred embodiment of the present invention includes a top panel having pairs of transparent electrodes 103 arranged on a front substrate 101 in group units, a black matrix layer 100 each arranged between, spaced from, and adjacent to the transparent electrodes 103, a dielectric layer 104 on the pair of the transparent electrodes 103 and the black matrix layers 100 for restricting a discharge current, and a protection layer on an entire surface of the dielectric layer 104. The black matrix layer 100 is formed by screen printing between, spaced from, and adjacent to the pair of the transparent electrodes 103. The screen printing is done repeatedly for 2~3 times with one time printing thickness of 5 μm~30 μm using a black insulating material to a desired thickness of 10 μm~100 μm. The dielectric layer 104 can be naturally formed in a round form only by printing or deposition of dielectric material without any application of separate process due to the already formed black matrix layer 100.

Figure 6:
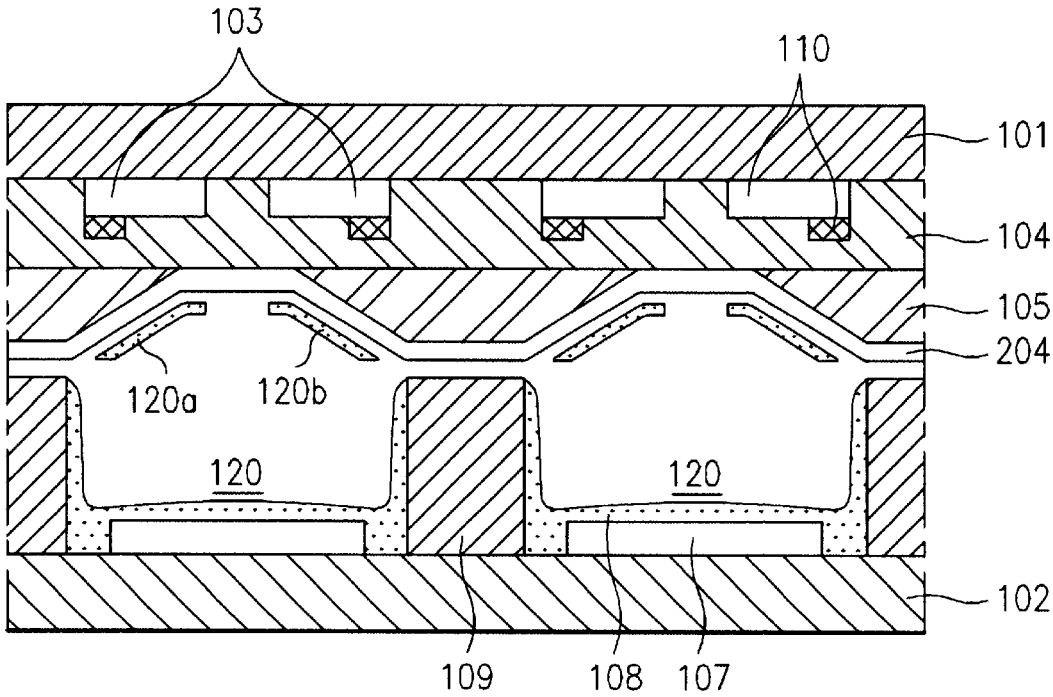
FIG. 6 illustrates a cross section of discharge cells in a PDP in accordance with a third preferred embodiment of the present invention; and, FIG. 7 illustrates a cross section of discharge cells in a PDP in accordance with a fourth preferred embodiment of the present invention.

Referring to FIG. 6, the PDP in accordance with a third preferred embodiment of the present invention includes a first dielectric layer 104 formed identical to the related art, a second dielectric layer 105 formed to have a varied thickness in a tapered form centered on a plasma discharge space 120 with a thickness thin at an electric field concentration portion of the pair of the display electrodes 110 and thick at an electric field dispersion portion of the pair of the display electrodes 110, and a protection layer 204 lined on the dielectric layer 104 for protecting the dielectric layer 104. The pair of display electrodes 110 have a width formed up to 80% of a pixel pitch.

Figure 7:
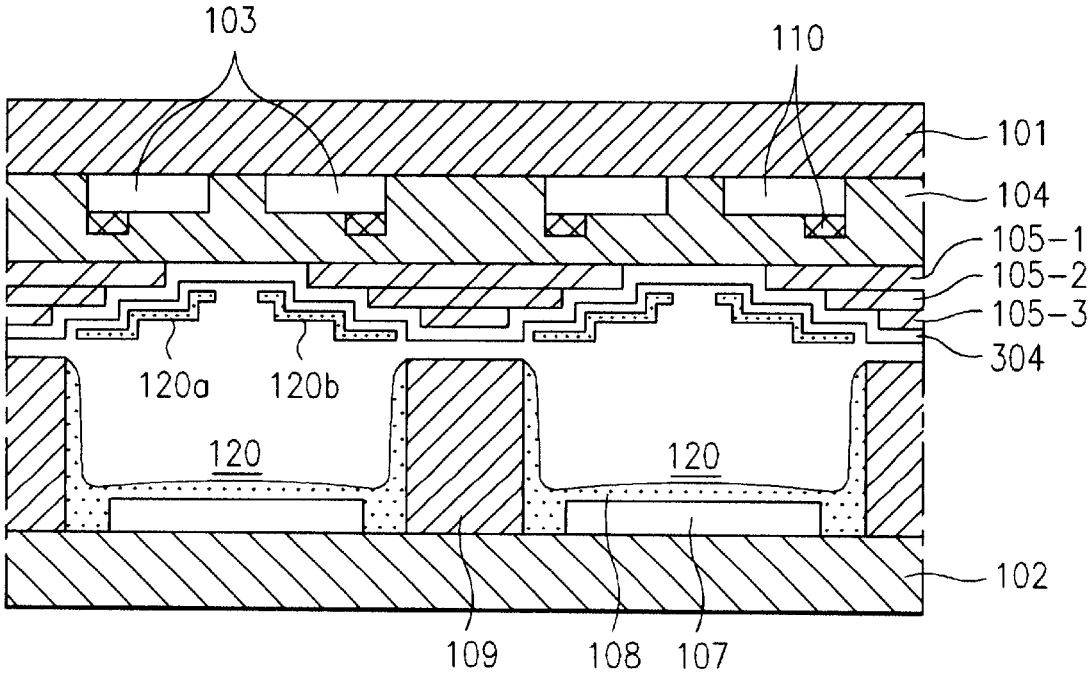

Referring to FIG. 7, a PDP in accordance with a fourth preferred embodiment of the present invention includes a first dielectric layer 104 formed identical to the related art, a second dielectric layer 105-1, 105-2, and 105-3 formed to have a varied thickness in a step form centered on a plasma discharge space 120 with a thickness thin at an electric field concentration portion of the pair of the display electrodes 110 and thick at an electric field dispersion portion of the pair of the display electrodes 110, and a protection layer 304 lined on the dielectric layer 105-1, 105-2, and 105-3 for protecting the dielectric layer 105-1, 105-2, and 105-3. The pair of display electrodes 110 have a width formed up to 80% of a pixel pitch. Rest of conditions are the same with the explanation in association with FIG. 4 except that the second dielectric film 105-1, 105-2, and 105-3 in FIG. 7 is formed by plural times of screen printing to vary a thickness step by step.

The dielectric layers 104 and 105 are formed to have a varied thickness for enlarging a discharge space and restricting a discharge dispersion, thereby dropping a discharge voltage and improving a discharge efficiency and a contrast.

In the meantime, there are barriers 109 on a region of a rear substrate 102 opposite to the variably etched dielectric layers 104 and 105 formed on the front substrate 101, and an address electrode 107 of a metal thin film deposited on an exposed surface of the rear substrate 102 and inside surfaces of the barrier 107. The address electrode 107 may be formed on the barrier 109 in a form of a metal on groove. Then, upon formation of a fluorescent material layer 108 on an entire surface of the address electrode 107 by electrophoresis, a bottom panel is completed. The fluorescent material layer 108 may also be formed by printing a fluorescent material paste of cellulose+acrylic resin+organic solvent(alcohol or ester) on a surface of the address electrode 107 to a thickness of 10~50 μm and baking at 400~600° C. The top panel and the bottom panel formed thus are bonded with Frit glass(not shown), and the discharge space 120 is evacuated of air, filled with an inert mixture gas of neon Ne, helium He, and xenon Xe, and sealed.

Figure 1:
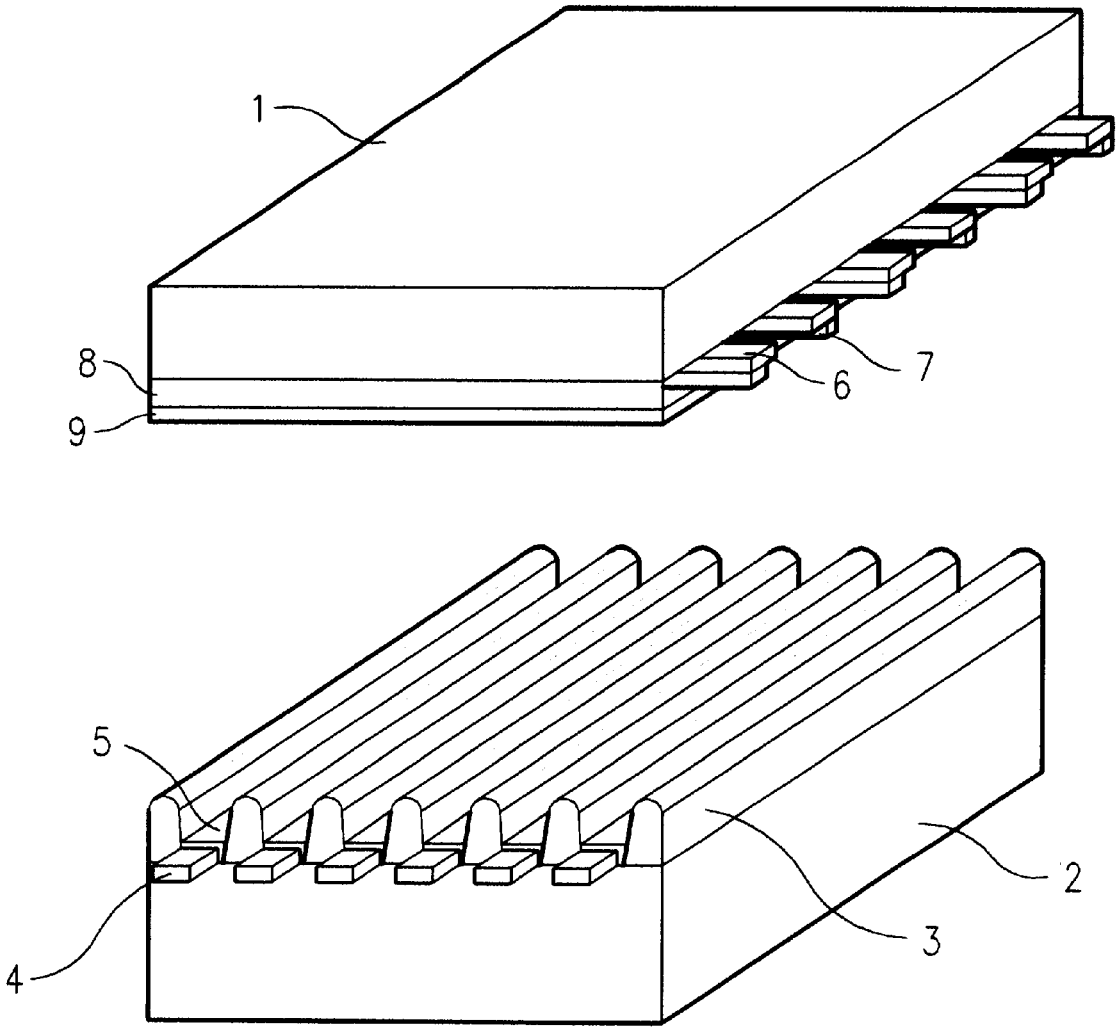
FIG. 1 Related Art
FIG. 1 illustrates an overall structure of a related art PDP.
Figure 2:
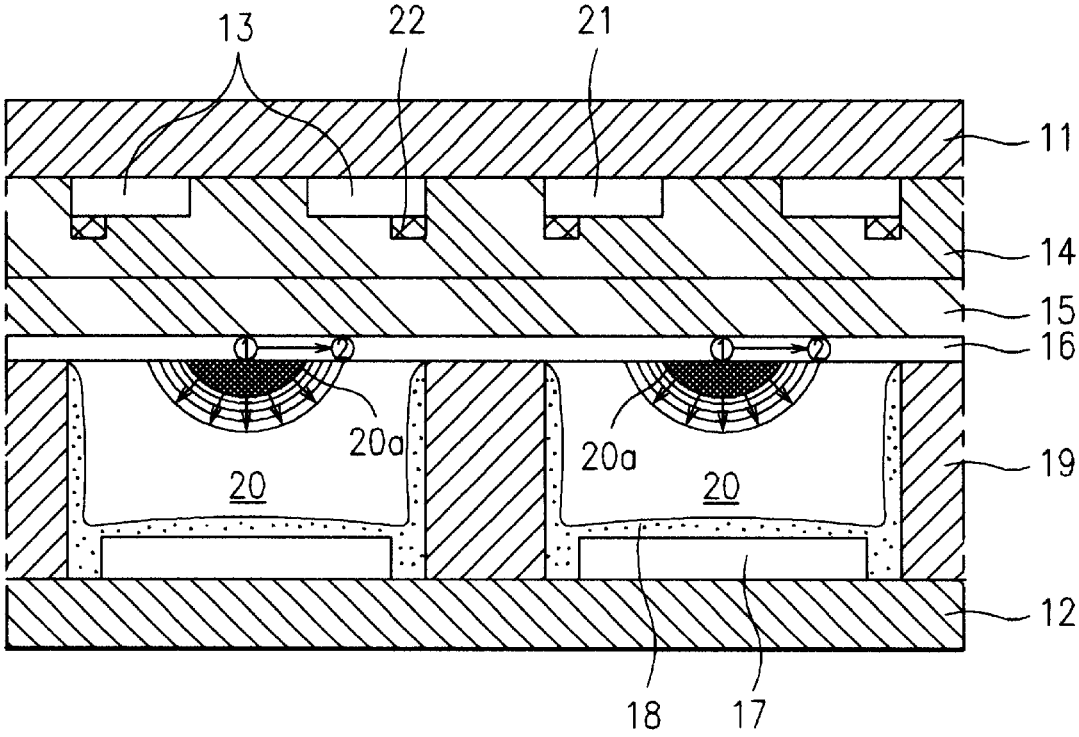
FIG.2 Related Art
FIG. 2 illustrates a cross section of discharge cells in a related art PDP.
Figure 3:
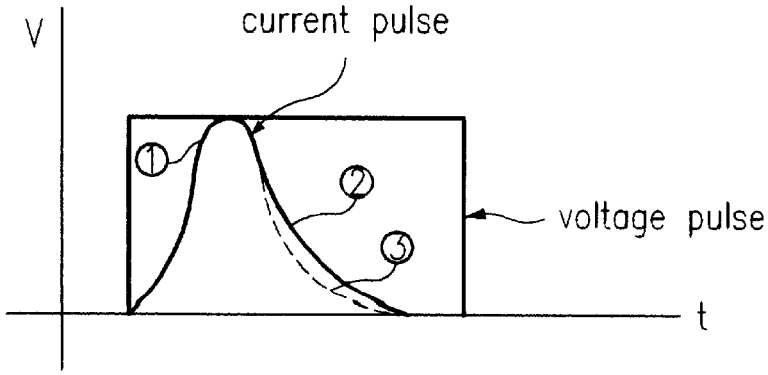
FIG. 3 illustrates a voltage waveform and a discharge current waveform applied to one pair of display electrodes.

In the aforementioned PDP of the present invention, upon application of a discharge initiation voltage to the pair of display electrodes 110, surface discharges 120*a* and 120*b* are occurred at surfaces of the dielectric layers 104 and 105 in the discharge space 120, emitting vacuum UV rays from the surface discharge 120*a* and 120*b* regions. The vacuum UV rays excite the fluorescent material layer 108, and the excited fluorescent material layer 108 emits a visible light, making a color display of R, G, B. Accordingly, in the present invention, by exciting the fluorescent material layer 108 by means of the vacuum UV rays emitted from the large surface discharge 120*a* and 120*b* regions, it is found that a contrast and a luminance are improved by at least 50% than the related art structure. And, as shown in FIGS. 6 and 7, by forming the second dielectric layer 105 to have a varied thickness in a taper form or step form centered on a plasma discharge space with a thickness thin at an electric field concentration portion and thick at an electric field dispersion portion, with which the discharge current can be fully cut off after the discharge initiation voltage is applied to the pair of display electrodes as shown in ③ in FIG. 3, a power consumption required for driving the PDP can be reduced, with an improved luminous efficiency. To do this, a width of the pair of the display electrodes 110 is formed wide up to 80% of a pixel pitch, providing a further stabilized luminous efficiency.

As has been explained, the color PDP with a varied thickness dielectric film of the present invention can be applicable to a gas discharge panel and the like that meets general requirement for a different display, such as a long lifetime, a contrast, and a luminance.

And, by forming a dielectric film with a varied thickness on pairs of display electrodes formed on a front substrate, forming barriers on a rear substrate opposite to the pairs of display electrodes, and forming an address electrode and a fluorescent material film in succession stacking on the rear substrate in the barriers, the PDP of the present invention can improve a luminance, can drop discharge initiation voltage to the maximum, and can improve a contrast.

It will be apparent to those skilled in the art that various modifications and variations can be made in the PDP with a varied thickness dielectric film of the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

a plurality of pairs of display electrodes formed on a front substrate, the electrodes forming the pairs being separated from each other by a gap;

a dielectric layer formed on surfaces of the pairs of the display electrodes; and a protection layer formed to a prescribed thickness on the dielectric layer, wherein the dielectric layer gradually varies at a prescribed taper substantially over a discharge space from a first thickness to a second thickness, and wherein a thickness of the dielectric layer varies over the gap.

2. The plasma display panel as claimed in claim 1, wherein the dielectric layer is formed thin at an electric field concentration portion and thick at an electric field dispersion portion.

3. The device of claim 2, wherein a transition from the thin portion of the dielectric layer to the thick portion of the dielectric layer is continuous.

4. The plasma display panel as claimed in claim 1, wherein the dielectric layer has a variable thickness of 5 $\mu$m~200 $\mu$m.

5. The plasma display panel as claimed in claim 1, wherein a width of a main discharge portion due to the dielectric layer is 30 $\mu$m~500 $\mu$m.

6. The plasma display panel of claim 1, wherein the second thickness is centered at an electric field concentration portion of the dielectric layer and the first thickness is located at an electric field dispersion portion of the dielectric layer associated with each display electrode, and wherein the second thickness is greater than the second thickness.

7. The device of claim 6, wherein a transition from the first thicknesses to the second thickness of the dielectric layer is continuous.

8. The device of claim 7, wherein the transition from the first thicknesses to the second thickness of the dielectric layer is in a form of a curve.

9. The plasma display panel of claim 1, wherein a gradient of the taper is uniform.

10. The plasma display panel of claim 1, wherein the taper is substantially in a form of an arc, which is substantially elliptical, and wherein a lowest point of the arc is substantially centered over the gap.

11. The plasma display panel of claim 1, wherein the taper is substantially linear.

12. The device of claim 1, wherein the thickness of the dielectric layer varies over the entire gap.

13. The device of claim 1, wherein the gap between the display electrodes is an electric field concentration portion of the pair of display electrodes.

14. The device of claim 1, wherein the thickness continuously varies and is substantially in the form of a curve.

15. The device of claim 1, wherein the thickness varies from the first thickness to the second thickness and back to the first thickness.

16. The device of claim 1, wherein the taper is substantially in the form a curve that begins at a first thickness, reduces to a second thickness, and increases to the first thickness in a continuous manner.

17. The device of claim 16, wherein a point of the taper having the second thickness is substantially centered over the gap.

18. The device of claim 1, wherein the second thickness is substantially centered over the gap, and wherein the thickness increases in both directions toward each of the display electrodes at a constant gradient to the first thickness such that the thickness of the dielectric is greater at an electric field dispersion portion of the pair of display electrodes than at an electric field concentration portion of the pair of display electrodes.

19. The plasma display panel of claim 1, wherein a discharge space in the dielectric layer is maximized and power consumption is minimized by gradually varying the dielectric layer at a prescribed taper from the first thickness to the second thickness.

20. A plasma display panel, comprising:

a plurality of pairs of display electrodes on a front substrate, and a black matrix layer formed between, spaced from, and adjacent to each of the pairs of display electrodes;

a first dielectric layer formed on the pairs of the display electrodes and the black matrix layers to a thickness;

a second dielectric layer formed to have a thickness which tapers in a round form on the first dielectric layer centered on a discharge space, the tapered thickness having an initial thickness at a center of an electric field concentration portion of the pair of display electrodes and continuously changing to a final thickness at an electric field dispersion portion of the pair of display electrodes; and a protection layer formed in a round form on the first, and second dielectric layers to a thickness.

21. The plasma display panel as claimed in claim 20, wherein the black matrix layer is formed to have a greater thickness than the display electrode.

22. The plasma display panel as claimed in claim 21, wherein the black matrix layer has a thickness of 10 $\mu$m~100 $\mu$m.

23. The plasma display panel of claim 20, wherein the final thickness is greater than the initial thickness.

24. The plasma display panel of claim 23, wherein the rate of taper is constant.

25. The plasma display panel of claim 20, wherein a discharge space in the dielectric layer is maximized and power consumption is minimized by tapering the thickness from the initial thickness to the final thickness.

26. The device of claim 20, wherein a thickness of the second dielectric layer over the electric field concentration portion varies.

27. The device of claim 26, wherein the thickness of the second dielectric layer over the electric field concentration portion varies over the entire electric field concentration portion.

28. The device of claim 26, wherein the electric field concentration portion of the pair of display electrodes comprises a gap between the display electrodes.

29. A plasma display panel, comprising:

a plurality of pairs of display electrodes on a front substrate, the electrodes forming the pairs being separated from each other by a gap;

a first dielectric layer formed on the pairs of the display electrodes to a thickness;

a second dielectric layer formed to have a thickness which varies in a tapered form on the first dielectric layer centered on a discharge space, the varied thickness having a first thickness at an electric field concentration portion of the pair of display electrodes and gradually changing to a second thickness at an electric field dispersion portion of the pair of display electrodes wherein the thickness of the dielectric layer varies over the gap; and a protection layer formed in a tapered form on the first, and second dielectric layers to a thickness.

30. The plasma display panel as claimed in claim 29, wherein a width of a main discharge portion due to the second dielectric layer is 30 $\mu$m~500 $\mu$m.

31. The plasma display panel of claim 29, wherein the final thickness is greater than the initial thickness.

32. The plasma display panel of claim 29, wherein a discharge space in the dielectric layer is maximized and power consumption is minimized by varying the thickness in the tapered form from the first thickness to the second thickness.

33. The device of claim 29, wherein a portion of the second dielectric layer over the electric field concentration portion has a thickness that varies.

34. The device of claim 33, wherein the electric field concentration portion of the pair of display electrodes comprises a gap between the display electrodes.

35. A plasma display panel (PDP) comprising:

a plurality of pairs of display electrodes on a front substrate;

a first dielectric layer formed on the pairs of the display electrodes to a thickness and having a first surface substantially parallel to a surface of the front substrate;

a second dielectric layer formed to have at least three thicknesses with respect to a surface of the first dielectric layer in a stepped form on the first surface of the first dielectric layer centered on a discharge space of the PDP, the varied thickness being thin at an electric field concentration portion of the pair of display electrodes and thick at an electric field dispersion portion of the pair of display electrodes; and a protection layer formed in a stepped form on the first, and second dielectric layers to a thickness.

36. The plasma display panel as claimed in claim 35, wherein a width of a main discharge portion due to the second dielectric layer is 30 $\mu$m~500 $\mu$m.

37. The plasma display panel as claimed in claim 35, wherein a width of the pair of display electrodes is not greater than 80% of a pixel pitch.

38. The plasma display panel of claim 35, wherein the thickness of each of the at least three steps is not more than 65 $\mu$m.

39. The plasma display panel of claim 35, wherein a discharge space in the dielectric layer is maximized and power consumption is minimized by forming the second dielectric layer to have at least three thicknesses in the stepped form.

40. The device of claim 35, wherein the protection layer follows a contour of the second dielectric layer.

41. A plasma display panel, comprising:

a plurality of pairs of display electrodes on a front substrate and a black matrix layer formed between, spaced from, and adjacent to each of the pairs of the display electrodes, wherein the black matrix layer has a thickness greater than the display electrode;

a dielectric layer formed on the pairs of the display electrodes and the black matrix layer to have a gradually varied thickness in a continuous form centered on a discharge space, the gradually varied thickness being a first thickness at an electric field concentration portion of the pair of display electrodes and a second thickness at an electric field dispersion portion of the pair of display electrodes; and a protection layer formed on the dielectric layer to a prescribed thickness, wherein the second thickness is greater than the first thickness, and wherein the continuous form dielectric layer has a thickness that varies over the electric field concentration portion.

42. The plasma display panel of claim 41, wherein a discharge space in the dielectric layer is maximized and power consumption is minimized by gradually varying the dielectric layer at a prescribed taper from the first thickness to the second thickness.

43. The device of claim 41, wherein from the first thickness to the second thickness, the taper being substantially in a form a curve that begins at a second thickness, reduces to a first thickness, and increases to the second thickness in a continuous manner, and wherein a point of the curve that is the first thickness is substantially centered on the electric field concentration portion.

44. The device of claim 41, wherein when the dielectric is formed in the continuation form, the dielectric layer has a thickness that tapers, the taper being substantially in a form of an arc form that is substantially elliptical, and wherein a lowest point in the arc is substantially centered over the electric field concentration portion.

45. The device of claim 41, wherein a thickness of the dielectric layer varies over the gap.

* * * * *